United States Patent [19]

Walla

[11] Patent Number: 4,914,932

[45] Date of Patent: Apr. 10, 1990

[54] LOCK WITH KEY OPERATED REMOVABLE PLUG

[75] Inventor: Gregg W. Walla, Lake Bluff, Ill.

[73] Assignee: Timberline Supply Ltd., Lake Bluff, Ill.

[21] Appl. No.: 765,843

[22] Filed: Aug. 15, 1985

[51] Int. Cl.[4] ..... E05B 27/00

[52] U.S. Cl. ..... 70/367; 70/371; 70/375

[58] Field of Search ..... 70/367, 369, 375, 371, 70/368, 379 R, 380

[56] References Cited

U.S. PATENT DOCUMENTS

| | | | |
|---|---|---|---|
| 1,123,004 | 12/1914 | Prescott | 70/379 R |
| 1,575,091 | 3/1926 | Best | 70/367 |
| 2,036,764 | 4/1936 | Lowe | 70/379 R |
| 2,100,233 | 11/1937 | Beaumont | 70/379 R |
| 2,506,846 | 5/1950 | Teasdale | 70/58 |
| 3,589,152 | 6/1971 | Glass | 70/371 |
| 4,068,510 | 1/1978 | Neary | 70/379 R |
| 4,325,237 | 4/1982 | Menzie | 70/371 |

*Primary Examiner*—Gary L. Smith
*Assistant Examiner*—Suzanne L. Dino
*Attorney, Agent, or Firm*—Wood, Phillips, Mason, Recktenwald & Vansanten

[57] ABSTRACT

The present invention comprises an improvement in a lock of the type having a cylinder with an associated internal cavity, a key operated lock plug rotatably mounted in the cylinder cavity and a coupling mounted for rotation relative to the lock cylinder for association with a lock member that is movable upon rotation of the coupling between locked and open states. Shoulders are provided on the plug and coupling and upon effecting relative rotation between the coupling and plug through a change key the shoulders can be selectively brought into interfering, facing relationship to prohibit withdrawal of the plug or misaligned to allow removal of the plug. An access key, that is longer than the change key, in a fully seated position in the plug keyway, extends into the coupling opening and is thereby keyed to the coupling so that turning of the control key directly operates the coupling.

7 Claims, 1 Drawing Sheet

LOCK WITH KEY OPERATED REMOVABLE PLUG

BACKGROUND ART

Field of the Invention

This invention relates to locks with removable and, more particularly, to a lock with a plug that is removable from and insertable into a cylinder with a change key and operable by an access key that is longer than the change key and directly interconnects the plug with a lock coupling.

BACKGROUND OF THE INVENTION

A known lock construction employs a key-operated plug that is rotatably mounted in a lock cylinder. The plug has a plurality of combinating tumblers normally radially biased outwardly into a longitudinal slot associated with the cylinder to prevent rotation of the plug within the cylinder cavity. The combinating tumblers read a properly bited key in the keyway and retract to allow rotation of the plug in the cylinder cavity. The assembled plug cooperates with a rotatable coupling that is in turn associated with a slide lock, a bolt, or other conventional type locking structure commonly used to secure sliding drawers, hinged doors and the like on office furniture, cabinets and similar.

It is desirable to have the plugs removable and interchangeable for the following reasons. In operations having large numbers of drawers, doors and the like that are regularly locked, it may be desirable to have common keying though the furniture may not be purchased at the same time or from a common source. For this reason, manufacturers of furniture find it convenient to provide a cylinder that is compatible with lock plugs manufactured by any of a number of different sources. The consumer need only insert a desired plug without having to change the entire locking system. The manufacturers of the furniture systems can therefore avoid involvement in the actual lock mechanism construction.

Another situation that makes interchangeability of plugs desirable is where the tenure of employees or tenants with keys is terminated. By replacing just the plug, future access through the lock can be prohibited without completely changing the locking system.

It is known, as exemplified in U.S. Pat. 4,398,405, to Patriquin, to provide two separate keys, one of which is termed a change key to allow removal of the plug and the other of which is commonly referred to as an access key to normally operate the plug between locked and unlocked positions. In Patriquin, a control tumbler is provided and seats in a slot formed directly in the cylinder to prevent the plug from being withdrawn. To operate the control tumbler, the change key has an extra bited portion to engage and retract the control tumbler and thereby allow removal of the plug from the cylinder.

One problem with the Patriquin structure is that the control tumbler is a thin, spring loaded disc. The disc and spring are susceptible to being broken, in which event the lock would malfunction.

The Patriquin structure is at the same time susceptible to being picked. By forcibly wedging out the plug, the control disc might be severed and the plug removed, thereby permitting access to the locked structure. Alternatively, the control disc might be withdrawn by an individual extending a wire or the like into the keyway. Little security is afforded by the Patriquin structure.

The Patriquin structure also presents problems from a manufacturing end. The slot that accepts the control tumbler or the stop against which the control tumbler bears is directly formed in the cylinder. It is very difficult and thereby costly to cast this structure directly in the cylinder.

Further, the requirement of the additional moving disc and associated biasing structure unduly complicates assembly. This is particularly true when the parts are small as they are in the lock plug. Further, the number of parts necessarily increases the likelihood of malfunction. Any malfunction of the control tumbler would render the lock ineffective for its purposes.

A still further drawback with the Patriquin and other conventional prior art locking system is that the change key must be in place in the keyway to assemble the plug in the cylinder. In large operations several master change keys may have to be made available to installers. It may therefore be difficult to keep track and/or prevent duplication of these master change keys. Loss of security for an entire operation may be lost requiring replacement of all plugs.

SUMMARY OF THE INVENTION

The present invention is specifically directed to overcoming the above enumerated problems in a novel and simple manner.

The present invention comprises an improvement in a lock of the type having a cylinder with an associated internal cavity, a key operated lock plug rotatably mounted in the cylinder cavity and a coupling mounted for rotation relative to the lock cylinder and in association with a lock member that is movable upon rotation of the coupling between locked and open states.

According to the invention, the plug end cooperates with the coupling in such a manner that shoulders on the coupling and plug interferingly face each other in a first position. Upon effecting relative rotation between the plug and coupling, the shoulders on the plug and coupling assume a second misaligned position, in which withdrawal of the plug from the cylinder can occur. The invention contemplates the use of keys of different length to effect insertion in and removal of the plug from the lock cylinder and operation of the plug. With a first, change key, the plug is rotatably movable with respect to the coupling to selectively align and misalign the cooperating shoulders on the coupling and plug. A second, longer key, an access key, in a fully seated position, penetrates an opening in the coupling and is keyed directly thereto so that relative rotational movement between the coupling and the plug is prohibited.

The invention contemplates direct interaction between the coupling and plug to prevent removal of the plug from the cylinder cavity. This structure positively maintains the plug in the lock cylinder. The applicant's lock, therefore, cannot be picked like the prior art locks and secures positively against unauthorized entry.

Another aspect of the invention is the provision of structure allowing snap-fitting of the plug and lock cylinder. Legs are provided on each of the plug and coupling members and each leg has an associated shoulder. Guiding surfaces associated with each of the legs on the coupling and plug encounter each other upon directing the plug into the lock cylinder. At least one of the guiding surfaces is ramped so that deflection of the legs occurs sufficiently to allow an axial overlapping position of the plug and coupling to be realized wherein the shoulders on each of the legs on the plug and coupling face each other interferingly. Accordingly, installation of the plug involves merely aligning the plug with the cavity and press fitting the same in place with or without a key present in the keyway associated with the plug. This facilitates placement of a large number of plugs which can be located and tapped into place with, for example, a hammer. As a result, an installer need not be given access to a change key. The security of the locking system can thus be assured.

Other objects and advantages of the invention will become apparent upon reading the following detailed description taken in conjunction with the drawings and the appended claims.

DETAILED DESCRIPTION OF THE DRAWINGS

Figure 1:
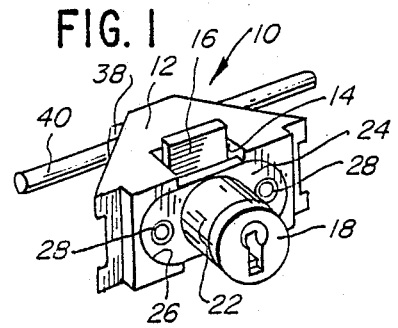
FIG. 1 is a perspective view of a first type of locking mechanism having a lock cylinder and removable plug wherein the incorporation of the present invention is appropriate.
Figure 7:
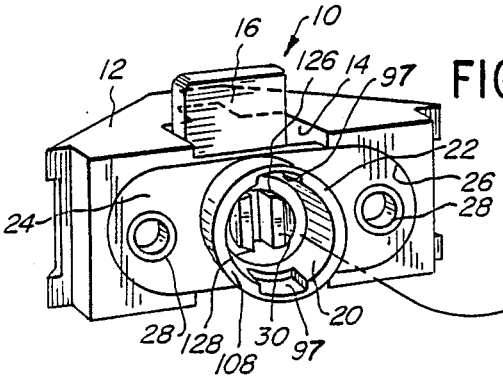
FIG. 7 is an exploded, perspective view of the locking mechanism of FIG. 1 with the present invention incorporated.
Figure 8:
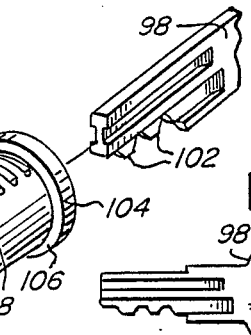
FIG. 8 is a side elevation view of a change key used to remove the plug from and replace the plug in the locking mechanisms of FIGS. 1, 3 and 5.
Figure 9:
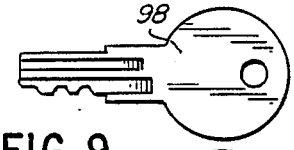
FIG. 9 is a side elevation view of an access key used to lock and unlock the mechanisms of FIGS. 1, 3 and 5.

A typical lock mechanism to which the present invention is particularly adaptable is shown in FIGS. 1 and 7 at 10. The mechanism 10 comprises a V-shaped housing 12 having a rectangular cut-out 14 through which a rectangular bolt 16 is vertically movable in response to rotation of a lock plug 18. The lock plug is fit in a cavity 20 internally of a cylinder 22 which is integrally formed with a mounting plate 24. The mounting plate is accepted in a conforming undercut 26 in the housing and is maintained on the housing by a pair of rivets 28.

Figure 2:
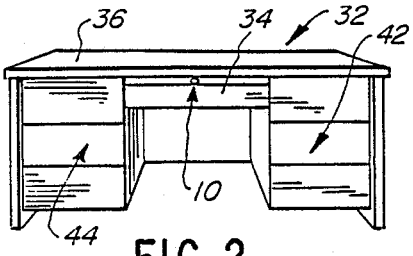
FIG. 2 is a front view of a desk with a center drawer typically incorporating a locking mechanism such as that in FIG. 1.

Associated with the lock cylinder 22 is a coupling 30 mounted for rotation about an axis coincident with the axis of the cylinder 22. The coupling is connected to an eccentric pin (not shown) which moves in a horizontal slot (not shown) in the bolt 16. Through the action of the pin in the slot upon rotation of the coupling 30, the bolt 16 is caused to extend and retract as desired. Typically, the locking mechanism 10 is associated with a desk as shown at 32 in FIG. 2. The desk 32 has a narrow rail above the center drawer 34 that is bored to closely accept the cylinder 22. Upon operating the lock, the bolt 16 can be selectively extended into a downwardly opening slot (not shown) associated with the desk top 36 to prevent opening of the drawer 34 and withdrawn to allow the drawer to be slidingly opened.

In one known construction, the bolt has an associated toothed rack (not shown) which meshes with a peripherally toothed disc 38 keyed to rotate with a cable 40. The end of cable 40 can be directed to operate a remote locking module, typically associated with a column of drawers as at 42, 44 in FIG. 2. The precise operation of the locking mechanism on the drawers is not critical to the present invention. It suffices to say that such structures may have a vertically adjustable slide bar movable through the mechanism 10 to selectively align and misalign lugs thereon with stops on the drawers to either prevent or allow withdrawal of the drawers.

Figure 3:
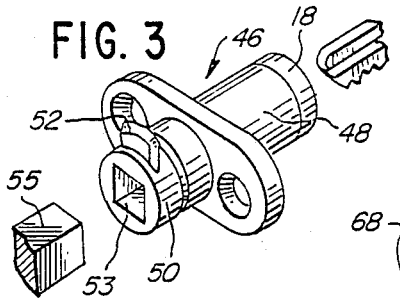
FIG. 3 is a perspective view of a second type of conventional locking mechanism suitable for incorporation of the present invention.

In FIG. 3, an alternative locking mechanism is shown at 46. The mechanism 46 comprises a cylinder 48 with an associated plug 18 that directly rotates a latch member 50 having an integral lug 52 that can be either aligned within a slot (not shown) associated with a drawer or door or rotated to move the lug 52 out of the slot to allow drawer or door operation. An opening 53 with a cross-section matched to a cable 55 for keyed connection therewith is optionally provided in the catch 50. The cable can be connected to a remote operator similarly to the cable 40 in FIG. 1.

Figure 4:
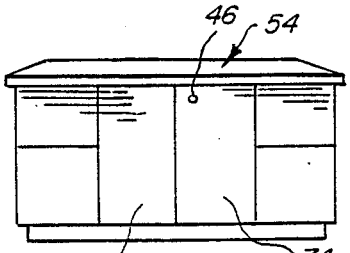
FIG. 4 is a front view of a cabinet having center doors that typically have incorporated a locking mechanism such as that in FIG. 3.
Figure 6:
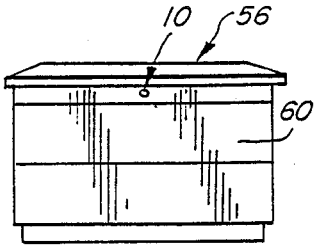
FIG. 6 is a front view of a cabinet wherein a lock such as that in FIG. 1 is incorporated on a stationary portion of the cabinet as opposed to incorporation on the door as in FIG. 4.

The mechanism 46 is typically associated with a cabinet such as that shown at 54 in FIG. 4 with a set of doors between sets of drawers. An alternative cabinet configuration suitable for incorporation of the mechanism 10 is shown at 56 in FIG. 6 and has a pair of slidable drawers 60.

Figure 5:
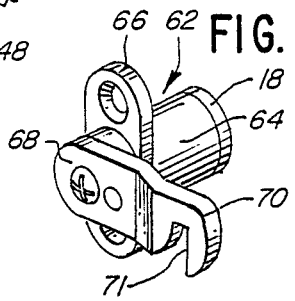
FIG. 5 is a still further type of common conventional locking mechanism typically used to lock simple cabinet doors.

A still further representative lock mechanism is shown in FIG. 5 at 62. The mechanism comprises a cylinder 64 and associated, integral mounting plate 66. The cylinder defines a cavity for rotatable reception of a lock plug 18. The lock plug 18 is connected to a latch member 68 having a hook 70 offset from the latch axis that can be used to lockingly engage a pin (not shown). The structure 62 is typically incorporated into a cabinet such as that in FIG. 4 to interlock adjacent, oppositely opening doors 72, 74. With the doors closed and the latch member 68 rotated to seat the pin in the hook opening 71, pivoting of either door 72, 74 is prohibited.

It should be understood that all three different types of mechanisms are only exemplary of those into which the present invention might be incorporated. It is contemplated that the inventive structure might be incorporated into other types of locking mechanism as well.

The inventive structure will now be described with respect to the representative lock mechanism shown in FIG. 1 and detailed in FIGS. 7 and 10–14.

The invention resides principally in the novel cooperating structure on the coupling 30 and plug 18. The coupling 30 has a conventional stepped configuration, which is not critical to the present invention. The thickest body portion 76 s journalled for rotation in a bore (not shown) in the mounting plate 24 so that the forward portion 78 of the coupling protrudes into the cavity 20 associated with the lock cylinder 22. The forward portion 78 of the coupling 30 is bifurcated to define legs 80, 82 which bound therebetween a space 84. Each leg has a ramped guiding surface 86, 88 that diverge from front to rear. At the rear edge of the guiding surfaces 86, 88 are rearwardly facing shoulders 90, 92. The conventional part of the plug 18 comprises a cylindrical body 94 with tumblerways 96 guiding movement of disc-like combinating tumblers (not shown). With the key 98 removed from a keyway 100 extending axially the length of the plug 18, the tumblers are biased radially into slots 96 associated with the cylinder 22 to prevent rotation of the plug 18 within the cylinder 22. The key 98 is called a change key and has a plurality of bites 102 which are read by the tumblers (not shown) and with the key 98 fully inserted retract the tumblers to allow rotation of the plug in the cylinder cavity 20. The cooperation of the key 98 with the combinating tumblers is conventional.

The plug 18 has an enlarged head 104 defining a shoulder 106 that bears on a forward, annular edge 108 on the cylinder 22 with the plug in a fully seated position. The plug has spaced legs 110, 112 with radially inwardly directed offsets 114, 116 respectively having ramped guiding surfaces 118, 120 diverging from front to rear and shoulder surfaces 122, 124 facing forwardly of the plug 18.

Figure 10:
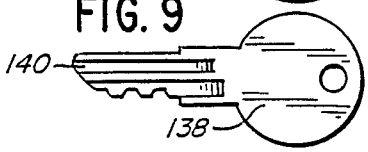
FIG. 10 is an exploded view of a snap-fit connection between the coupling and lock plug.
Figure 10:
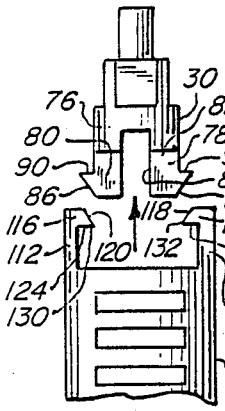
Figure 11:
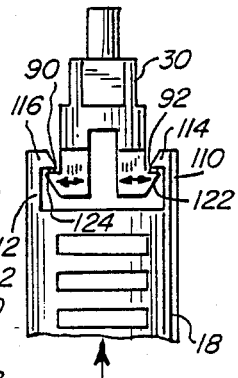
FIG. 11 is a view similar to that in FIG. 10 with the coupling and plug assembled.
Figure 12:
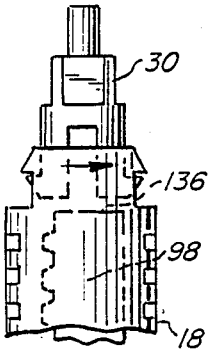
FIG. 12 is a view similar to that in FIG. 11 with the key of FIG. 8 in the keyway of the plug rotated 90° from the FIG. 11 position so that relative rotation can occur between the coupling and plug.
Figure 13:
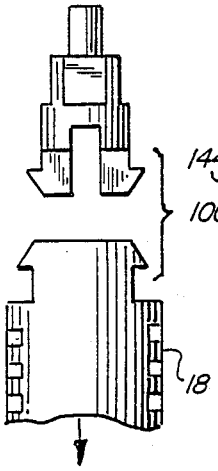
FIG. 13 is a view similar to that in FIG. 10 with the coupling and plug positioned for assembly and relatively rotated 90° away from the positions of FIGS. 10 and 11.

The invention contemplates two different methods of assembling the plug and coupling. In FIGS. 10 and 11, a snap-fit connection is demonstrated. In FIG. 10, the plug and coupling are shown axially aligned for assembly. To effect assembly, the plug and coupling are directed axially towards each other causing the guiding surfaces 118, 120 on the plug 18 to encounter the guiding surfaces 86, 88 on the coupling. The ramped surfaces cooperate with each other to deflect the legs 80, 82 on the coupling radially inwardly toward each other and simultaneously the legs 110, 112 on the plug radially outwardly away from each other. This allows an axial overlapping position of the coupling and plug to be effected. Upon the fully seated plug position being realized, as shown in FIG. 11, the legs on both the coupling and plug assume their undeflected state, causing the coupling shoulders 90, 92 to face interferingly against the shoulders 122, 124 of the plug to prevent relative axial movement between the plug and coupling, This can be accomplished with or without a key in place in the keyway. The above arrangement facilitates rapid assembly of large numbers of plugs. For example, one can place the plug in the cylinder cavity and seat the plug with a sharp rap from a hammer.

Preferably, both the coupling and body are made from a die cast metal, which permits the modicum of flexing required to effect assembly of the coupling and plug. It is within the scope of the invention to make one or the other of the coupling and plug of a different, more deformable material than the other so that one of the plug and coupling deforms upon the plug being inserted and the other of the plug and coupling remains rigid.

The second method of assembling the plug and coupling according to the invention will be described with respect to FIGS. 7 and 12–14. The legs 80, 82 on the coupling have oppositely facing flat sides 126, 128. Accordingly, the arcuate shoulders 90, 92 defined on the legs each extend less than 180° about the coupling. The dimension between the flat sides 126, 128 is less than the spacing between the forward extremities 130, 132 of the ramped guiding surfaces 118, 120 on the plug 18, between which extremities a radial slot 134 is defined.

To assemble the plug and cylinder, the change key 98 is inserted into the keyway 100 to retract the combinating tumblers. With the key 98 fully seated in the plug, the leading edge 136 of the key terminates axially short of the legs 110, 112 on the plug and therefore short of the coupling in assembled relationship of the plug shown in FIG. 12. Further, the plane of the key is situated transversely to the length of the space 84 between the coupling legs. With the coupling and plug in the FIGS. 12 and 13 alignment, the plug can be extended fully into the cylinder cavity and removed therefrom without interference.

To effect locking of the plug against axial shifting within the cylinder cavity, the plug is rotated relative to the coupling in either direction through 90°. This moves the shoulders on the coupling and plug so that they face each other interferingly as in FIG. 11 and withdrawal of the plug from the cylinder cavity is prohibited. In the locked position, the plane of the key 98 aligns parallel with the length of the space between the legs of the coupling. Upon removal of the key 98, the combinating tumblers seat selectively in the slots to prevent rotation of the plug in the cylinder cavity so that the plug is simultaneously fixed against rotational and axial movement relative to the cylinder 22.

Figure 14:
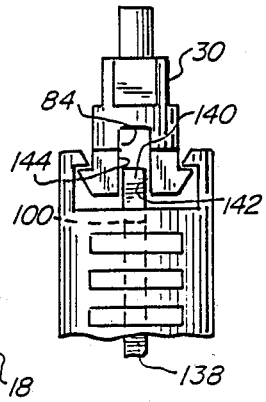
FIG. 14 is a view similar to that in FIG. 13 with the plug and coupling assembled and the key of FIG. 9 inserted and drivingly penetrating an opening associated with the coupling.

The key 98, because it does not extend into engagement with the coupling, cannot effect movement thereof. Accordingly, an access key 138 is provided and is longer than the change key 98. As seen in FIG. 14, with the plug and coupling locked together, the access key 138 can be extended fully into the plug so that the end portion 140 penetrates the space 84 between the coupling legs. The access key cooperates with the edges 142, 144 of the legs defining the opening 84 so that the coupling follows rotational movement of the key 138. The key 138 prohibits relative rotational movement between the plug and coupling to prevent inadvertent assumption of the separating positions of FIGS. 12 and 13. The direct engagement of the key 138 and coupling assures that the force applied to the key is transmitted positively to the coupling.

The foregoing description was made for purposes of demonstrating the structure and operation of the present invention, with no unnecessary limitations to be understood therefrom.

I claim:

1. An improved lock of the type having a lock cylinder with an internal cavity having an axial extent, a key operated lock plug for removable placement in said lock cylinder cavity for rotation relative to the lock cylinder, and a coupling rotatably mounted with respect to the lock cylinder and cooperating with a lock member to move the lock member upon rotation of the coupling between a locked state and an open state, the improvement comprising:

means for snap-fitting the plug into operative relationship with the coupling upon directing the plug axially into the cavity with the plug and coupling in a first relative rotational position; and means for releasing the snap-fit plug from the coupling upon the plug being rotated relative to the coupling from said first relative rotational position to a second relative rotational position wherein the snap-fit plug can be separated from the coupling by withdrawing the plug axially with respect to the lock cylinder, whereby the plug can be simply press fit into operative relationship with the lock cylinder and coupling.

2. The improved lock according to claim 1 wherein said snap-fitting means comprise deformable, spaced legs on the lock plug each having a shoulder surface and a shoulder on the coupling and means for deflecting the legs on the plug radially upon directing the plug axially into the cavity, said legs with the plug in a fully seated position assuming an undeflected state and thereby seating the shoulder surfaces on the legs in facing, interfering relationship with the shoulder on the coupling.

3. The improved lock according to claim 1 wherein said snap fitting means comprises deformable, spaced legs on the coupling each having a shoulder surface and a shoulder on the plug and means for deflecting the legs on the coupling radially upon directing the plug axially into the cavity, said legs with the plug in a fully seated position assuming an undeflected state and thereby seating the shoulder surfaces on the legs in facing, interfering relationship with the shoulder on the plug.

4. The improved lock according to claim 1 wherein said plug and coupling each are die cast metal parts.

5. The improved lock according to claim 2 wherein the means for deflecting the legs comprises cooperating guiding surfaces on the plug legs and coupling and the guiding surfaces have a ramped configuration to radially deflect the plug legs upon assembly of the plug and lock cylinder.

6. The improved lock of claim 3 wherein said coupling has a bifurcated end defining the spaced legs and an opening therebetween, the means for deflecting the legs comprises cooperating guiding surfaces on the coupling legs and plug, the guiding surfaces having a ramped configuration to deflect the coupling legs radially inwardly, said plug has a keyway alignable with the opening between the coupling legs and a key can be inserted fully into the plug keyway to extend into the space between the coupling legs and maintain the spacing between the legs to prevent deformation of the legs that might cause inadvertent separation of the plug and cylinder.

7. An improved lock of the type having a lock cylinder with an internal cavity, a lock plug having a keyway and being positionable in the lock cylinder cavity for rotation relative to the lock cylinder about an axis, said lock plug having a shoulder facing axially of the plug in a first direction, and a coupling having a shoulder facing oppositely to said plug shoulder and rotatably mounted with respect to the lock cylinder, said coupling being engageable with a lock member that is movable upon rotation of the coupling between a locked state and an open state, the improvement comprising:

said coupling having spaced edges defining an opening aligned with the keyway with the plug assembled to the lock cylinder;

said plug being rotatable relative to the coupling to (a) a first relative rotational position wherein the shoulders on the coupling and plug misalign in an axial direction relative to the lock cylinder for removal of the plug from the cylinder cavity and to (b) a second relative rotational position wherein the shoulders on the coupling and plug face each other interferingly to prohibit withdrawal of the plug from the cylinder cavity;

a change key which when fully inserted in the keyway does not extend into the coupling opening so that the plug can be rotated relative to the coupling, an access key extendable through the keyway and having a portion which extends into the coupling opening with the access key in a fully inserted position, said key portion with the access key in a fully inserted position engaging the spaced edges and upon rotation of the plug directly rotating the coupling for movement of the lock member between the locked and open states; and means to snap-fit the coupling and plug together in the second relative rotational position of the plug and coupling upon directing the plug into the cylinder cavity axially towards the coupling, said plug being rotatable from the second relative rotational position of the plug and coupling to the first relative rotational position upon a short key being inserted in the keyway and turned with the plug in the lock cylinder whereupon the snap-fit plug can be separated from the coupling and lock cylinder.

* * * * *